US008567707B2

(12) United States Patent
Bensen, IV

(10) Patent No.: US 8,567,707 B2
(45) Date of Patent: Oct. 29, 2013

(54) MULTIPLE CARGO STRAP WINDERS

(75) Inventor: Cornelius W. Bensen, IV, Roxboro, NC (US)

(73) Assignee: Strap Store LLC, Roxboro, NC (US)

( * ) Notice: Subject to any disclaimer, the term of this patent is extended or adjusted under 35 U.S.C. 154(b) by 264 days.

(21) Appl. No.: 13/095,966

(22) Filed: Apr. 28, 2011

(65) Prior Publication Data

US 2012/0273607 A1 Nov. 1, 2012

(51) Int. Cl.
*B65H 75/30* (2006.01)

(52) U.S. Cl.
USPC ..... 242/394; 242/394.1; 242/419.9; 242/420.4

(58) Field of Classification Search
USPC ..... 242/394, 394.1, 419.9, 420.4
See application file for complete search history.

(56) References Cited

U.S. PATENT DOCUMENTS

| | | | | | |
|---|---|---|---|---|---|
| 2,746,691 | A | * | 5/1956 | Hoad | 242/415.1 |
| 2,998,878 | A | * | 9/1961 | Biedinger et al. | 400/245 |
| 3,312,319 | A | * | 4/1967 | Carroll et al. | 192/18 B |
| 3,627,222 | A | * | 12/1971 | Quenot | 242/394.1 |
| 4,946,115 | A | * | 8/1990 | Muller | 242/289 |
| 5,975,455 | A | | 11/1999 | Alegre | |
| 6,150,745 | A | * | 11/2000 | Carpenter | 310/90.5 |
| 7,017,847 | B2 | | 3/2006 | Treat | |
| 7,281,677 | B2 | * | 10/2007 | Anderson | 242/422.2 |
| 2006/0022104 | A1 | | 2/2006 | Treat | |
| 2007/0221897 | A1 | | 9/2007 | Cardona | |

* cited by examiner

*Primary Examiner* — Sang Kim
(74) *Attorney, Agent, or Firm* — James G. Passé; Passé Intellectual Property, LLC

(57) ABSTRACT

The present invention relates to a device for winding a plurality of cargo straps thereon where the cargo straps can be removed without disturbing other mounted cargo straps due to a free-wheeling winding cylinder mount on the axle for each cargo strap to be mounted on the axle.

5 Claims, 7 Drawing Sheets

MULTIPLE CARGO STRAP WINDERS

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to cargo strap winders. In particular, the present invention relates to cargo strap winders that allow multiple straps to be independently wound.

2. Description of Related Art

The use of tie down cargo web straps are frequently utilized with flat bed and tractor trailer beds. It is not uncommon for these vehicles to be equipped with single winches or winders hung from rails mounted to the underside of the trailer or somewhere on the bed of a truck. The winders comprise some form of a drum upon which the cargo strap may be spooled and also may include a ratchet mechanism to hold the strap under tension. The web strap is normally stored on the winch spool itself, and while in some instances the spool can be positioned, it is of a limited means of movement.

Numerous devices have been proposed and introduced over the past decades to facilitate and process the safe and efficient winding or storage of a cargo strap on the drum. However, for smaller vehicles without built in winches, storage is mainly accomplished by leaving the straps loose in the bed, a cargo box, or container. Leaving the straps loose means a substantial amount of time is wasted in untangling the web straps for use each time. Cargo strap theft is a frequent problem and an inconvenience, particularly where cargo straps are left out in the open where they are accessible to thieves. Furthermore, storing the webs on winches, loose on the cargo bed, and the like exposes them to the elements making use difficult and shortening the life and utility of the straps.

Accordingly, there has developed a need over the years for a means for storage and utilization of multiple web based straps where no built in winches exist and which easily facilitates their storage and individual use.

BRIEF SUMMARY OF THE INVENTION

The present invention relates to a device for accepting two or more cargo straps for winding and storage of the strap. The freewheel feature allows a single strap to be removed without spinning the remaining cargo straps around the axle or requiring the axle to spin to remove the cargo strap.

In one embodiment of the present invention the device refers to a cargo strap winding device for a plurality of cargo straps comprising:

a) a first and second end plate each plate having an inside face and an outside face;

b) an axle having a first end and a second end each end mounted to the inside face of the first and second end plate respectively in a manner which allows the axle to rotate circumferentially in a horizontal configuration;

c) a winding handle attached to the first end of the axle and positioned on the outside face of the first end plate for rotating the axle;

d) a plurality of strap winding cylinders circumferentially mounted on the axle, each cylinder designed for accepting a cargo strap;

e) a plurality of magnets mounted in the axle and at least one magnet in each winding cylinder arranged such that when the handle is turned to rotate the axle, the magnets in the axle grab the magnets in the winding cylinders and cause the winding cylinders to rotate with the axle while allowing rotation free of the axle while a strap mounted thereon is removed; and f) dividers separating each of the plurality of winding cylinders mounted circumferentially on the axle.

DETAILED DESCRIPTION OF THE INVENTION

Figure 1:
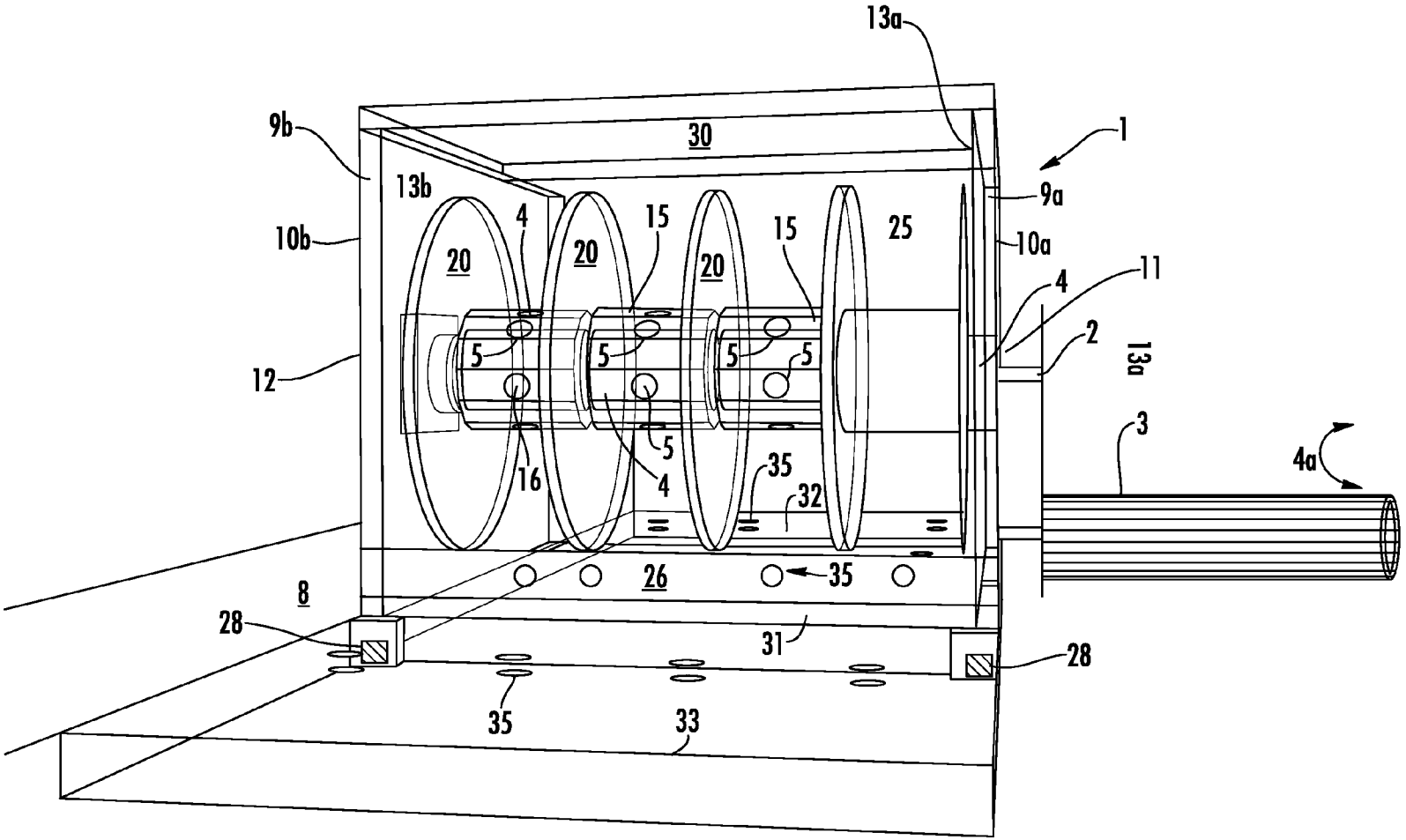
FIG. 1 is a frontal view of the winder of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "cargo strap" refers to a web strap for holding down cargo or other items in the bed of a truck or other vehicle. One first end is usually squared off with no buckle or other device, with the opposite end having a buckle which the first passes through to form a loop for holding down the cargo. A "winding device" for a cargo strap is a device wherein the first end of the strap can be placed on the device and the entire strap wound around the winding device. Usually that means some form of cylindrical center axle. By "plurality of cargo straps" as used herein means the device is capable of having 2, 3, 4, 5, or more cargo straps attached to the device separate from one another (i.e. next to one another) as opposed to on top of one another.

As used herein the "end plate" refers to wood, plastic, metal, or the like plates which hold the ends of an axle off the ground at a height enough to wind a strap around it. The longer the strap, the higher the axle must be kept off the ground. Typically the end plate will have a hole roughly centered or at any position desired for positioning the axle ends which can allow for free rotation of the axle. Rectangular or other shaped plates can be utilized. In one embodiment, there is an insert in the plate which aids the axle in rotation where the axle rests on the end plate, such as a plastic bearing type surface.

The axle is positioned with a first end in a first end plate and a second end in a second end plate, the end plates positioned essentially parallel to one another with the axle attached to the inside face of each of the end plates in a manner which allows the axle to rotate circumferentially in a horizontal configuration with the axle ends resting and rotating on the end plates. When sitting on a flat surface the axle will then be rotating essentially parallel to the flat surface. Likewise, the axle can be made of wood, metal, or plastic as desired based on cost, strength, and the like and the material chosen is within the skill in the art in view of the disclosure herein. The axle is positioned in a groove or hole on the inside surface of the end plates such that it not only rotates in the holes or grooves but a handle positioned on the outside surface of the endplates can be mounted to the end of the axle (for example, by a hole through the end plate whereby a hole in the end of the axle can be accessed by a screw or hole in the handle. In other embodiments, a hexagonal shaft on the handle fits onto a hexagonal hole in the axle end, In other embodiments the axle can be locked on place so that it cannot rotate, for example, by a cog and spring loaded level as shown on the drawings.

As used herein a "winding handle" is a handle attached to an end of the axle and positioned on the outside face of one of the end plates such that when the handle is rotated, it rotates the axle circumferentially. The handle can be attached to either end and can be attached by any method known in the art, such as a bolt configuration, cotter pin arrangement, hexagonal shaft/hole configuration, or the like.

For each strap to be attached to the axle, there is a strap winding cylinder circumferentially mounted on the axle. Each cylinder is designed to accept a single cargo strap to be wound entirely around the circumference of the cylinder. For example, if a 2 inch wide cargo strap is to be wound a 2 to 2.5 inch winding cylinder could be used. To make the device more universal, each winding cylinder could be much wider than the strap to be mounted so the winding cylinder could be 2, 3, 4, or 5, inches or more wide. The winding cylinder is big enough in its inner circumference to freely rotate around the axle, but not so large as to wobble to a great deal. In one embodiment, the circumference of the inner surface of the winding cylinder is no greater than 1 to 2 mm greater than the outer circumference of the axle. However, in view of this disclosure, optimum distances can be determined by one skilled in the art for the described activity. Each winding cylinder is then mounted on the axle with the axle designed in its length to accommodate the number of desired winding cylinders. In one embodiment there are 2, 3, 4, 5, 6 or more winding cylinders on the axle. In one embodiment there is just enough room so than when the device is assembled there is little ability for the winding cylinders to move back and forth (axially) on the axle to prevent uneven winding of the cargo strap during the winding procedure.

In the assembly of the axle, a plurality of magnets are mounted in the axle. They are positioned such that when one or more magnets of sufficient strength are also positioned in each winding cylinder, the magnets of the axle and winding cylinder line up and are positioned with opposing poles (thus attracting and grabbing each other) such that there is enough magnetic attraction that when the handle is turned rotating the axle, the winding cylinders also rotate with the axle. However, the magnets should not be so strong that when one holds the handle (thus fixing the axle in position) and one pulls on a strap wound around the winding cylinder, the cylinder will overcome the grabbing attraction and rotate around the axle thus facilitating the removal of a strap wound around the winding cylinder.

In order to prevent or resist a strap being wound around a winding cylinder from winding unevenly on the winding cylinder, each of the winding cylinders has a divider separating the winding cylinders from each other. These can be round or any other convenient shape and in one embodiment a radius sufficient to be larger than the radius of a strap wound around the winding cylinder in use. Additionally, dividers can be used to separate the straps from the end plates.

In use, a user places the non-buckle end of a cargo strap on an open winding cylinder and begins winding the handle, which in turn rotates the axle and winding cylinder which causes the strap to wind around the winding cylinder. To remove the strap, the user holds the handle or locks the axle in place, grabs the buckle and pulls the strap till it unwinds from the device the winding cylinder rotating as the user pulls on the strap overcoming the force of the magnets holding the cylinder around the axle.

In one embodiment of the invention, the winding part of the device can be enclosed. This is accomplished by attaching a top, bottom, front, and back wall, (or partial walls which make a wall when closed) to the end panels. The added walls can be hinged, Velcroed (hook and loop fasteners), or otherwise attached to have an open position to access the straps or add straps, or a closed position to protect the device and any straps from the elements when it's mounted to a truck bed outdoors. In one embodiment, vent holes are mounted in at least one wall or the end panels for drainage and wind flowing through. In another embodiment the device is mounted to a truck, for example, by mounting the end panels, optional bottom, or other walls to the bed or walls of the bed of a truck, such as a pickup truck.

In another embodiment of the invention, a plurality of devices could be attached to one another end-to-end by their axle ends. By providing a protruding shaft/matching hole (e.g. FIG. 5), shafts of multiple devices can be driven by a single handle at one or both of the open axle ends not connected to another device.

In yet other embodiments there is a mechanism for attaching the device to a vehicle, for example, magnets, magnetic base plate, bolts, or the like.

Now referring to the drawings. In FIG. 1 a frontal perspective view of the cargo strap winding device 1 is shown. In this view, handle 3 is attached to axle 4. Rotation of handle 3 in the direction 4*a* allows the axle to rotate in the same direction circumferentially, essentially horizontal to surface substrate 8 which is flat and level in this view but could be at any angle or the like. The handle is attached to the axle end 11 in this view by screw 2 but any attachment means for a handle cranking an axle can be utilized and is within the skill in the art. It should be noted that the axle 4 is seen in a see through view as if the outer pieces were clear and could be if the materials are chosen to be see through, such as clear plastic materials. However, in many embodiments the materials utilized to construct device 1 would include non-see-through materials, such as metals or wood and non-clear plastics. This one embodiment is utilized for convenience of viewing the workings of device 1.

The axle 4 is positioned horizontally between a first endplate 9*a* and a second endplate 9*b* in such a way that it freely rotates when handle 3 is turned 4*a*. This can be accomplished by inserting the axle in holes drilled in the endplates 9*a* and 9*b* or any other means know in the art. In one embodiment shown axle end 11 passes through end plate 9*a* for attachment to handle 3. It should be noted that the handle 3 is positioned on the outer face 10*a* of endplate 9*a* but could likewise be on the outer face 10*b* of end plate 9*b* or be adapted to be placed at either end as desired by the user of device 1. The axle 4 is essentially positioned then between the first inner face 13*a* and second inner face 13*b*.

In this embodiment of device 1 the device is adapted to accommodate 4 cargo straps but as noted 2 or more could be utilized as desired. The axle 4 is outfitted on its surface with axle magnets 5 wherein one or more magnets 5 are positioned on the surface of axle 4 for each of the straps that can be accommodated by device 1. In this view, there are five magnets 5 paced circumferentially around the outer surface of axle 4 roughly in the center of where a strap will go. In other words this embodiment has twenty axle magnets 5, or five magnets for each strap.

For each cargo strap to be accommodated by device 1 there is a corresponding strap winding cylinder 15. Therefore in this embodiment, there are four strap winding cylinders 15. Each cylinder 15 is circumferentially mounted on axle 4. Each strap winding cylinder 15 has cylinder magnets 16 positioned on its inner surface that is the surface facing the outer surface of axle 4 where axle magnets 5 are mounted. They are mounted such that they are positioned to mate the axle magnets and are also positioned such that opposite poles will face each other on the other surface of axle 4 and the inner surface of strap winding cylinder 15. Accordingly, when the magnets are lined up, rotation of axle 4 will cause the strap winding cylinder to rotate in concert with the axle 4. In one embodiment they are matched magnet for magnet but there can be less in either the axle or winding cylinder. The magnets chosen are such that when a cargo strap is wound on the winding cylinder and the straps are pulled, the winding cylinder will free wheel. One skilled in the art can chose magnet strength based on the disclosure of function herein and will be determined by the size of device 1 as well as the strap and the like. Each of the winding cylinders 15 are separated by dividers 20 which keep a wound strap from winding on neighboring winding cylinders. In this view there is a single cargo strap 25 wound around one of the winding cylinders for an example of how they are stored. One can clearly see the dividers 20 help keep the cargo strap 25 evenly on the winding cylinder 15. One can also see how the magnets align between the winding cylinders and the axle 4 such that when the axle 4 is rotated by handle 3, the winding cylinders 15 can wind a cargo strap like strap 15 around a winding cylinder.

Other optional features can also be seen in this embodiment. Bracing strap 26 is mounted between the end plates 9*a* and 9*b* to keep them aligned and properly spaced. In addition by adding a top 30, bottom 31, rear wall 32, and front wall 33, the device 1 can be enclosed when not in use or during storage. It is noted that the front wall 33 and real wall 32 are folding down for adding a cargo strap but can be folded up during storage. Front and rear walls 33 and 32 are shown to have vent holes 35 for allowing aeration, drainage and air flow circulation when the device 1 is enclosed. In other embodiments magnets 28 are positioned in the bottom of the device for attaching to the sheet metal body of a vehicle.

Figure 2:
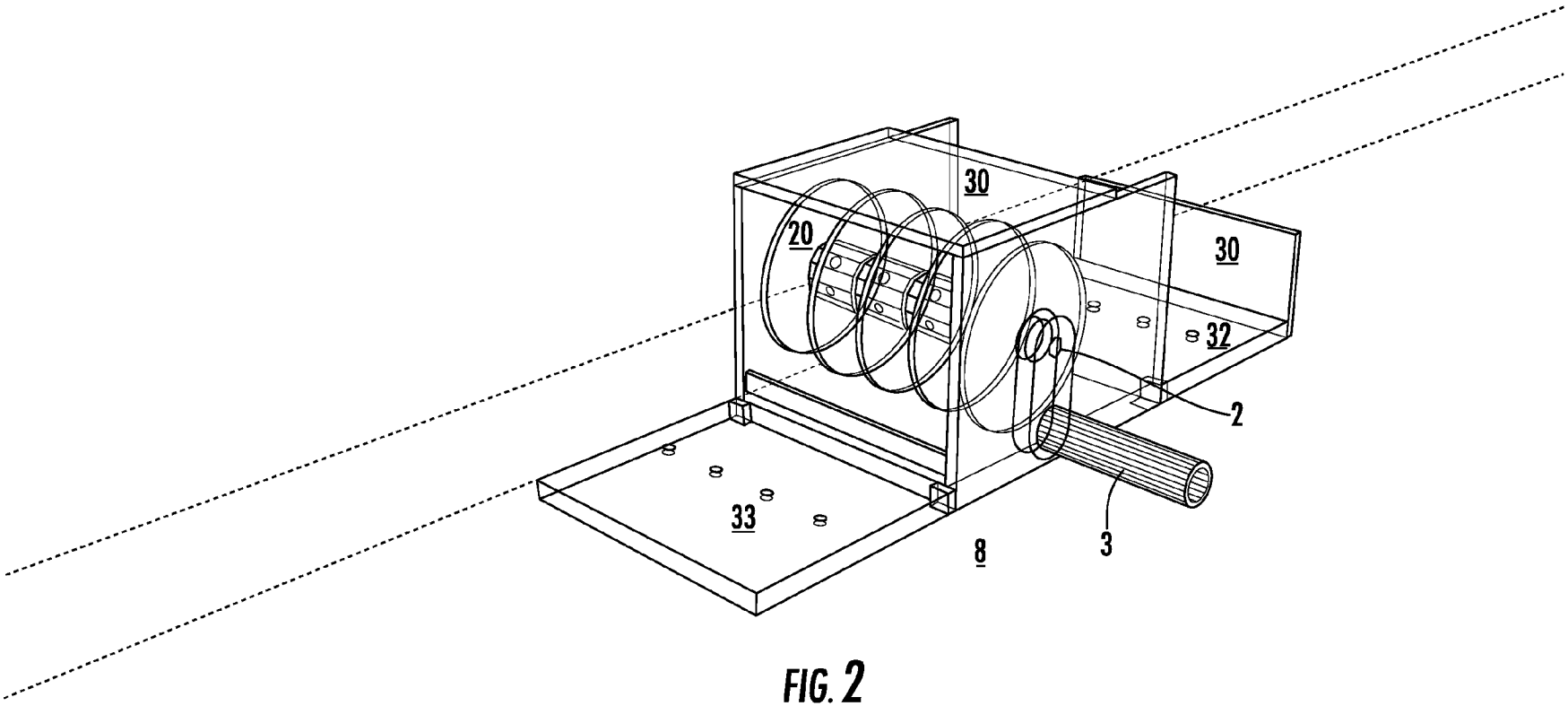
FIG. 2 is a perspective front right view of the present invention.
Figure 3:
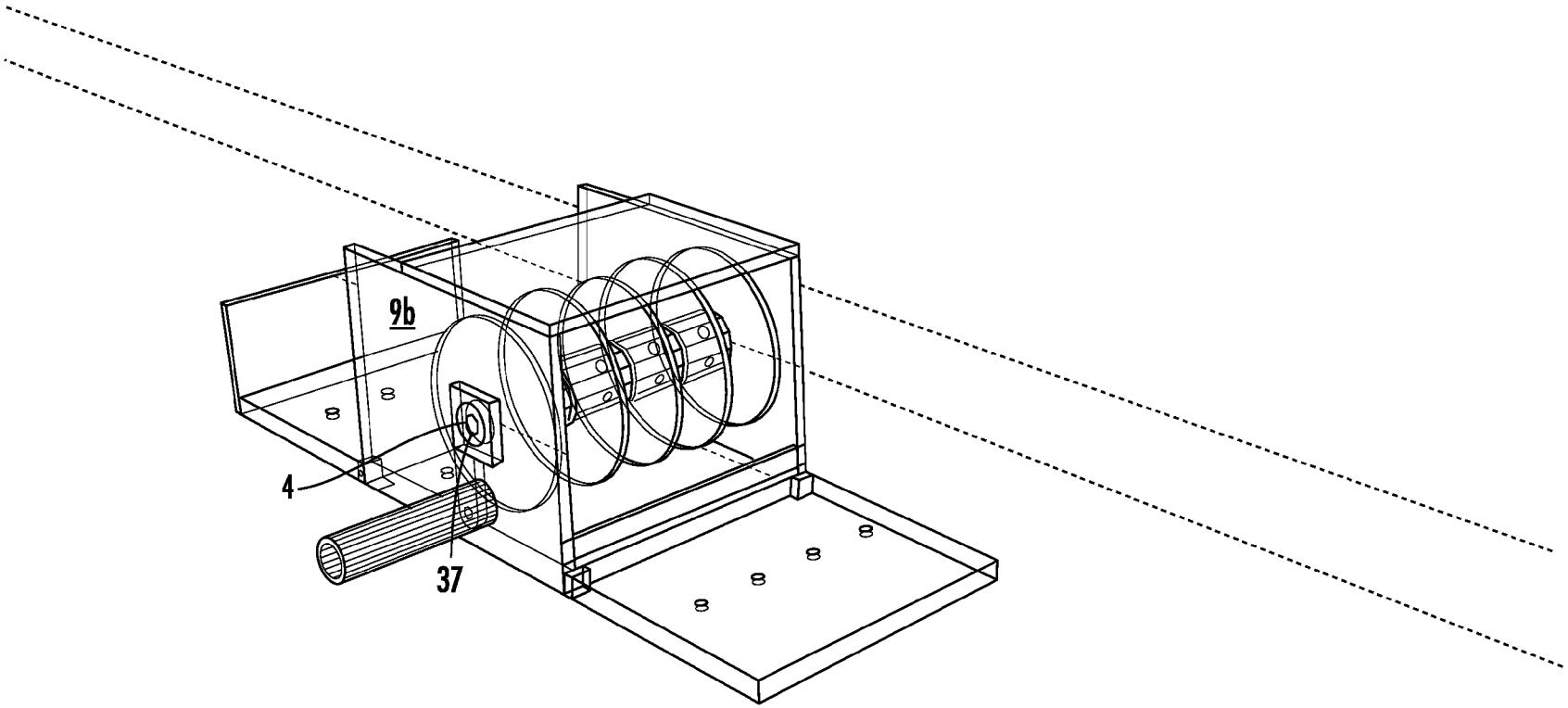
FIG. 3 is a perspective front left view of the present invention.

FIG. 2 is a right perspective view of device 1 wherein the handle 3 can be more clearly seen as well as the wall placement before folding up. FIG. 3 is a left perspective of the device 1 wherein the end plate 9*b* is adapted to receive handle 3 at position 37 so that the handle may be mounted on either end plate.

Figure 4:
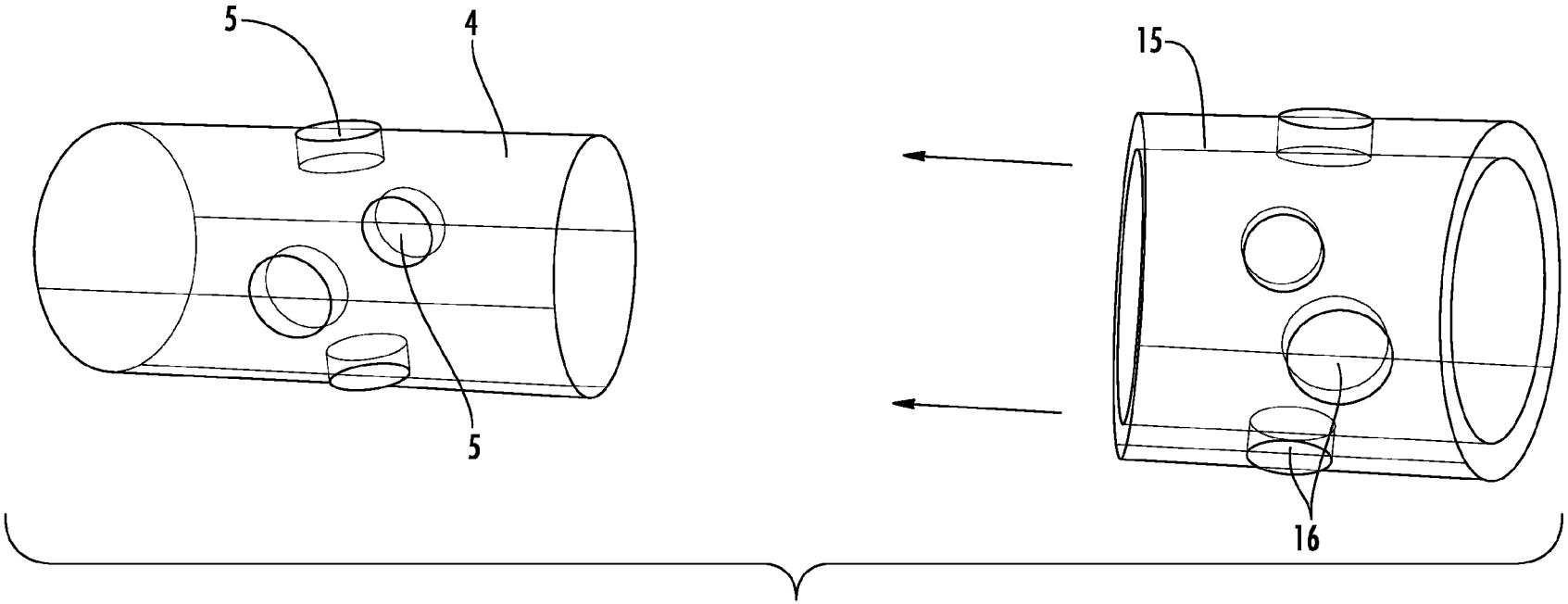
FIG. 4 is an exploded view of a winding cylinder on a portion of the axle.

FIG. 4 is an exploded view of a portion of axle 4 and a single strap winding cylinder 15. In this view the axle magnets 5 can clearly be seen and when winding cylinder 15 is placed over axle 4, the winding cylinder magnets 16 will line up one for one with opposite poles, thus allowing the winding cylinder to rotate with axle 4.

Figure 5:
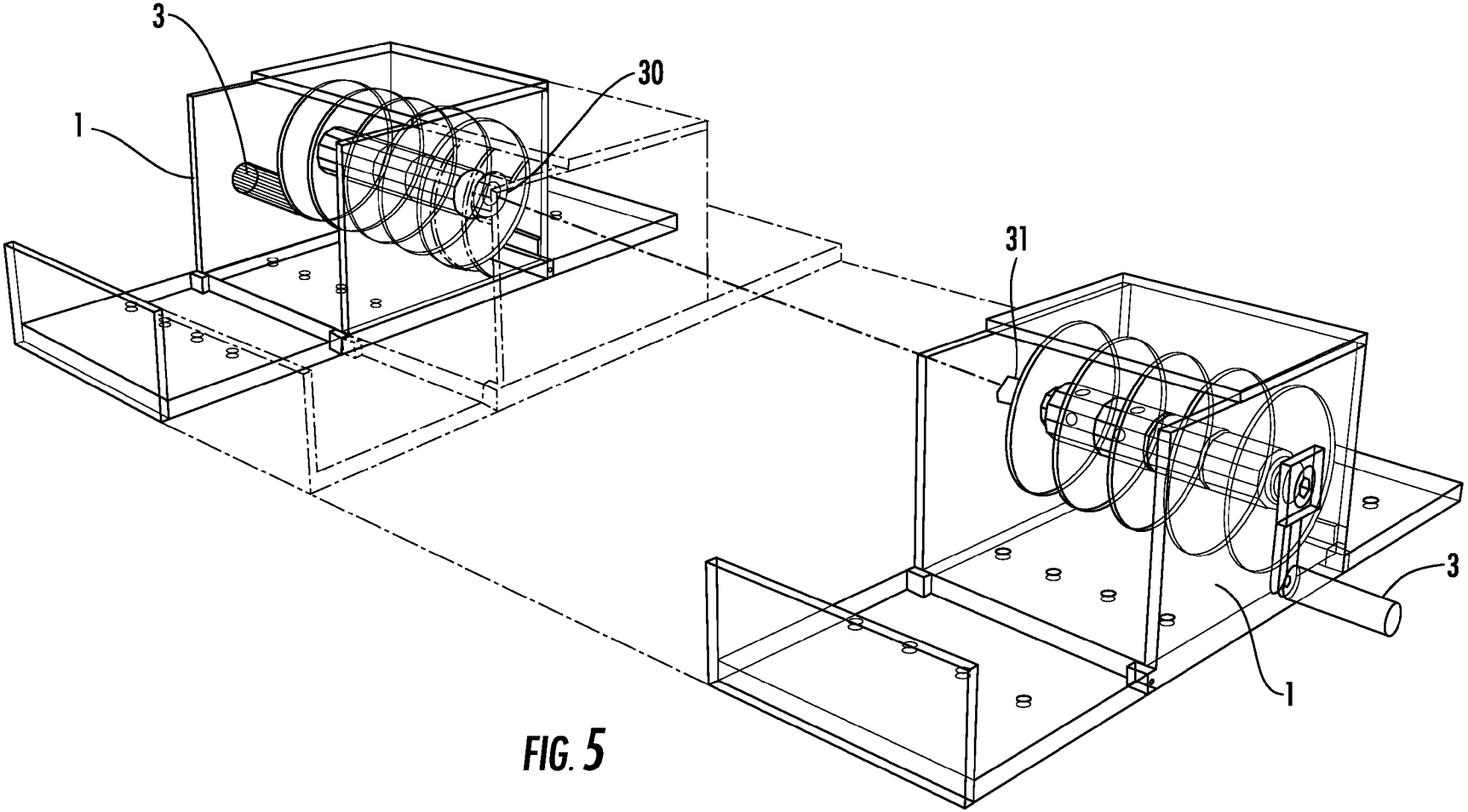
FIG. 5 is an exploded view of two devices attached end-to-end by their axle's.

FIG. 5 is an exploded view which shows two devices 1 which are connected via the ends of other axles. Axle shaft end 31 fits into axle end hole 30 and links the two devices such that handle 3 at either open end and attached to an axle can rotate the axle of both devices at once, thus in this example accommodating 8 cargo straps.

Figure 6:
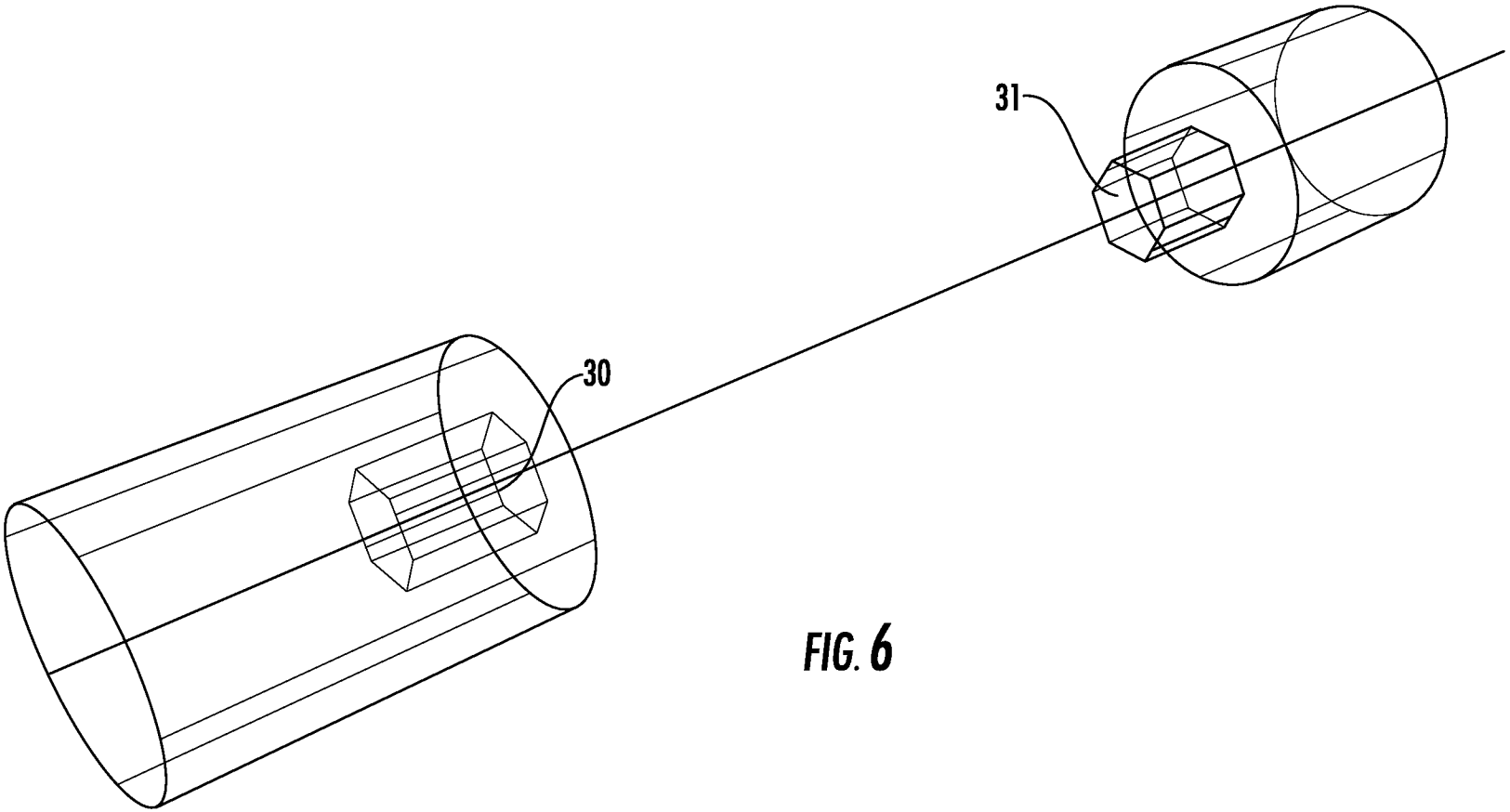
FIG. 6 is a perspective view showing the ends of two axles arranged for end-to-end joining.

FIG. 6 is an exploded view of the axles of two devices and how they join for simultaneous rotation.

Figure 7:
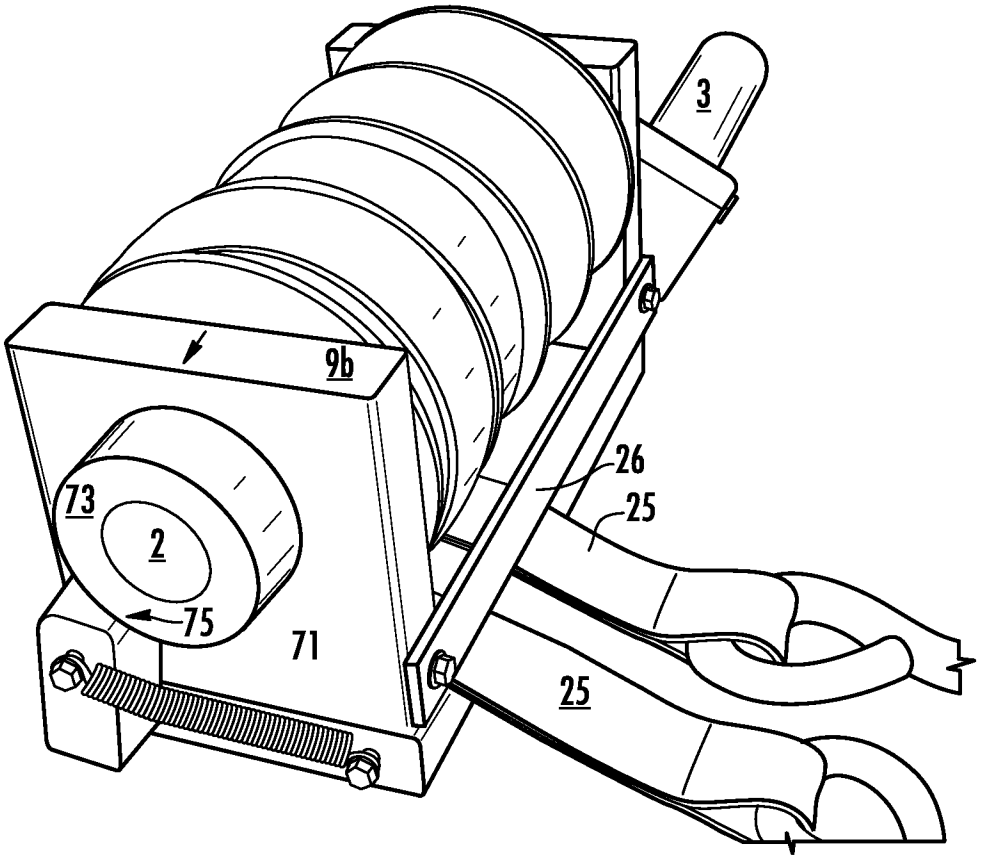
FIG. 7 is a perspective view of an axle lock for preventing rotation during strap removal.

FIG. 7 is a cog and spring loaded catch which locks the axles from rotation while removing a strap and rotating a winding cylinder. FIG. 7 is a perspective view of a locking mechanism for preventing axle rotation during strap removal. The locking mechanism comprises a block 70 and spring 71. An axle wheel 73 mounted on axle 2 is held in place by block 70 via tension created by spring 71. Block 70 engages notch 75 which is cut so that the block 70 does not interfere with winding the straps 25 onto the device but locks axle 2 when a strap 25 is pulled off the device.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A cargo strap winding device for a plurality of cargo straps comprising:

a) a first and second end plate each plate having an inside face and an outside face;

b) an axle having a first end and a second end each end mounted to the inside face of the first and second end plate respectively in a manner which allows the axle to rotate circumferentially in a horizontal configuration;

c) a winding handle attached to the first end of the axle and positioned on the outside face of the first end plate for rotating the axle;

d) a plurality of strap winding cylinders circumferentially mounted on the axle each cylinder designed for accepting a cargo strap;

e) a plurality of magnets mounted in the axle and at least one magnet in each winding cylinder arranged such that when the handle is turned to rotate the axle, the magnets in the axle grab the magnets in the winding cylinders and cause the winding cylinders to rotate with the axle to allow winding of a strap around the winding cylinder while allowing the winding cylinder to rotate free of the axle when a strap mounted on the winding cylinder is removed; and f) dividers separating each of the plurality of winding cylinders mounted circumferentially on the axle.

2. The winding device according to claim 1 wherein there is a top, bottom, front and back wall connecting the first and second end plates having an open configuration for accessing the winding cylinders and a closed position enclosing the winding cylinders.

3. The winding device according to claim 2 wherein there are drainage holes in at least one of the top, bottom, front and back walls.

4. The winding device according to claim 1 wherein the handle can be mounted to either the first or second end of the axle.

5. The winding device according to claim 1 wherein a plurality of devices are connected via their axle, end-to-end and operated via a single handle at an open end of one of the devices.

* * * * *